United States Patent [19]

Tetenborg et al.

[11] Patent Number: 4,574,560

[45] Date of Patent: Mar. 11, 1986

[54] APPARATUS FOR CLOSING FILLED SACKS

[75] Inventors: Konrad Tetenborg; Helmut Hüwelmann, both of Lengerich, Fed. Rep. of Germany

[73] Assignee: Windmoller & Holscher, Lengerich, Fed. Rep. of Germany

[21] Appl. No.: 727,102

[22] Filed: Apr. 25, 1985

[30] Foreign Application Priority Data

Apr. 26, 1984 [DE] Fed. Rep. of Germany ..... 3415604

[51] Int. Cl.[4] ..... B65B 51/14

[52] U.S. Cl. ..... 53/373; 53/371; 53/383; 53/526

[58] Field of Search ..... 53/373, 371, 383, 378, 53/379, 380, 381 R, 387, 570, 571, 573, 526, 527

[56] References Cited

U.S. PATENT DOCUMENTS

| | | | |
|---|---|---|---|
| 3,866,395 | 2/1975 | Timmerbeil | 53/373 |
| 3,968,629 | 7/1976 | Gidewall et al. | 53/373 |
| 4,241,560 | 12/1980 | Deimel et al. | 53/379 X |
| 4,510,736 | 4/1985 | Muller | 53/373 X |

FOREIGN PATENT DOCUMENTS

| | | | |
|---|---|---|---|
| 2013486 | 9/1971 | Fed. Rep. of Germany | 53/371 |

*Primary Examiner*—James F. Coan

*Attorney, Agent, or Firm*—Fleit, Jacobson, Cohn & Price

[57] ABSTRACT

Apparatus for closing filled sacks, preferably large sacks, which consist at least in part of thermoplastic material, comprises a feeder for feeding the filled sacks into a closing station. The feeder preferably comprises a roller conveyor or a belt conveyor. The apparatus also comprises means for holding the top end portion the sack above the contents of the sack, pressure-applying bars, which are parallel to each other and adapted to be lowered onto the contents of the sack on both sides of the sack end portion, which is held taut, which pressure-applying bars when in a lower position define between them a gap for the passage of the sack between said bars, and closing means provided above the pressure-applying bars. The closing means comprise welding bars and backing bars, which engage the sack end portion between the end-holding means and the pressure-applying bars and are disposed on opposite sides of said sack end portion. That of the pressure-applying bars which is disposed on the trailing side of the sack is provided with adhesive discharge nozzles directed toward the upper wall portion of the sack in contact with the contents of the sack, and that of said pressure-applying bars which is disposed on the leading side of the sack comprises a folding edge or folding rod, which faces the end of the sack. When the end seam weld has been formed and the welding and backing bars have released the sack and the conveyor has subsequently been restarted said folding edge or folding rod causes the end portion of the sack to be folded down onto and forced against the flattened upper portion of the trailing wall of the sack.

7 Claims, 1 Drawing Figure

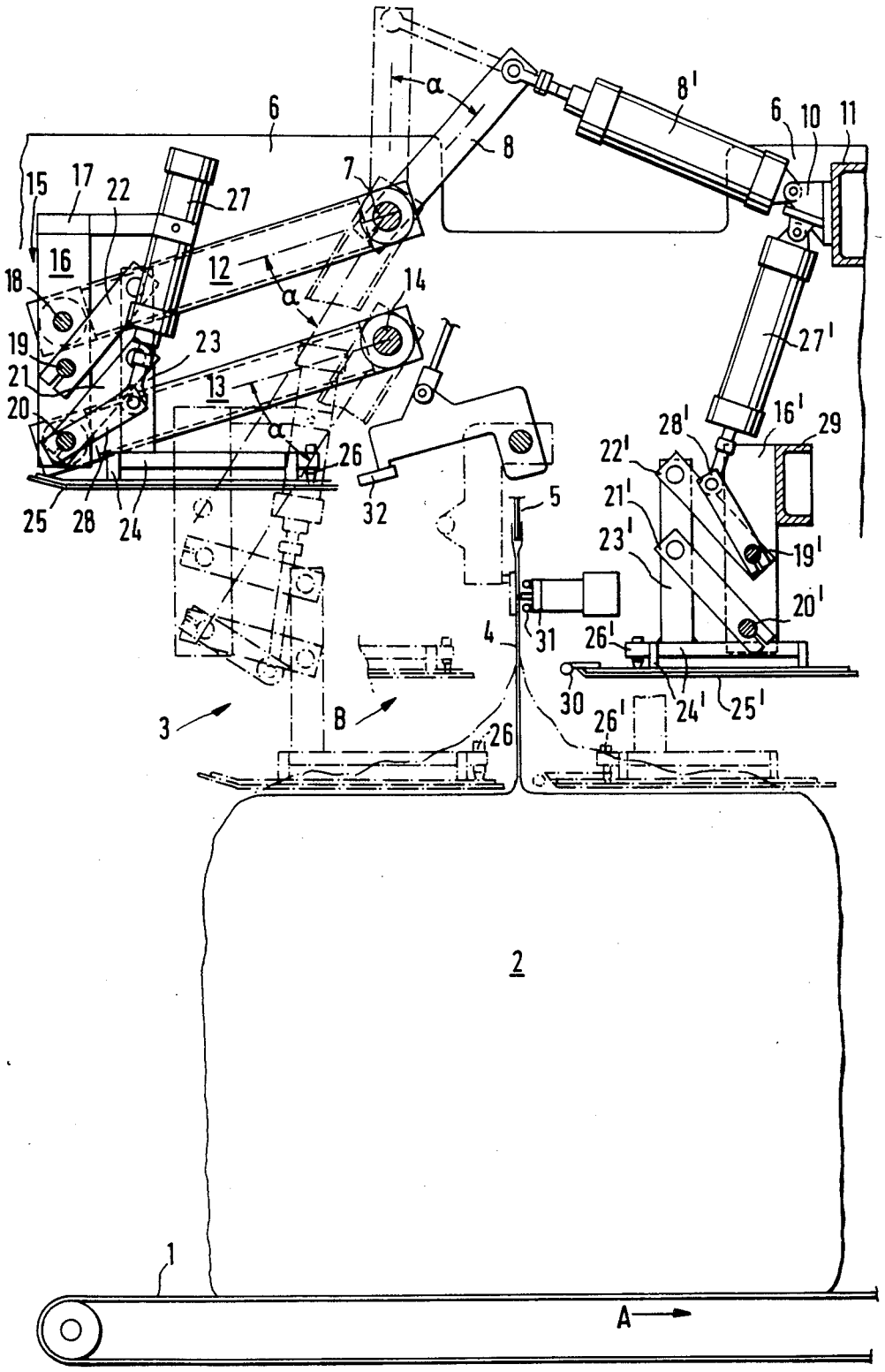
6
8'
6
10
11
α
8
7
15
17
22
27
16
12
α
14
18
19
23
21
20
13
α
26
25
28
24
32
5
27'
16'
28'
29
22'
21'
23'
19'
20'
4
31
26'
30
24'
25'
26'
3
B
26
2
1
A

APPARATUS FOR CLOSING FILLED SACKS

BACKGROUND OF THE INVENTION

1. Field of the Invention

This invention relates to apparatus for closing filled sacks, preferably large sacks, which consist at least in part of thermoplastic material, comprising a feeder for feeding the filled sacks into a closing station, which feeder preferably comprises a roller conveyor, or a belt conveyor also comprising means for holding the top end portion of the sack above the contents of the sack, pressure-applying bars, which are parallel to each other and adapted to be lowered onto the contents of the sack on both sides of the sack end portion, which is held taut, which pressure-applying bars when in a lower position define between them a gap for the passage of the sack between said bars, and closing means provided above the pressure-applying bars.

2. Description of the Prior Art

Apparatus of that kind has been disclosed in German Patent Publication No. 12 65 643 and comprises a channel-shaped folding rail, which is linked by levers to links which carry one of the pressure-applying bars. When the sack end portion has been released by the expanding means, that rail is pivotally movable over the sack end portion by means of a fluid-operable piston-cylinder unit so as to reversely fold that sack end on itself and when the belt conveyor is restarted said folded sack end portion is introduced into track rails and is fed along said track rails to a sewing machine for fixing the sack end portion in its reversely folded position.

Particularly large sacks which have been filled are desired to be closed at their top end by means of a seam weld by which said top end is also secured to the sack.

SUMMARY OF THE INVENTION

It is an object of the invention to provide an apparatus which is of the kind described first hereinbefore and by which the top end portions of filled sacks, particularly of large sacks, can be welded and firmly bonded to the sack so that compact packages are obtained which can be conveniently stored.

That object is accomplished in accordance with the invention in that the closing means comprise welding bars and backing bars, which engage the sack end portion between the end-holding means and the pressure-applying bars and are disposed on opposite sides of said sack end portion, that of the pressure-applying bars which is disposed on the trailing side of the sack is provided with adhesive discharge nozzles directed toward the upper wall portion of the sack in contact with the contents of the sack, and that of said pressure-applying bars which is disposed on the leading side of the sack comprises a folding edge or folding rod, which faces the end of the sack and when the end seam weld has been formed and the welding and backing bars have released the sack and the conveyor has subsequently been restarted said folding edge or folding rod causes the end portion of the sack to be folded down onto and forced against the flattened upper portion of the trailing wall of the sack.

The apparatus in accordance with the invention can be used to make compact closed sacks, which can be stored and transported within a small space. The welding means release the top end portion of the sack as said end portion is folded down.

When the sack end portion has been folded down onto and secured to the body of the sack, wings of said end portion will laterally protrude form the sack. Said wings can also be secured to the sack if, in accordance with a further feature of the invention, that pressure-applying bar which is disposed on the leading side of the sack is also provided with adhesive discharge nozzles directed toward the downfolded sack end portion. When glue strips have been applied by said adhesive discharge nozzles, the protruding wings of the downfolded sack end portion are folded against said glue strips and forced against them so that said wings are fixed to the sacks.

Further advantageous features of the invention will be recited in the dependent claims.

BRIEF DESCRIPTION OF THE DRAWING

The single FIGURE of the drawing is a sectional view showing the closing apparatus.

DETAILED DESCRIPTION OF THE PREFERRED EMBODIMENT

An illustrative embodiment of the invention will now be described more in detail with reference to the drawing.

A large sack 2 which has been filled in a filling station is fed by a belt conveyor 1 in a feeding direction A from the filling station to the sealing and gluing station 3. During the feeding of the sack, the open top end portion 4 of the sack is held in a vertical position and stretched in width by grippers 5, which are moved in unison with the belt conveyor 1 by means which are not shown.

The welding and gluing station 3 comprises a frame having two side frames 6. Only the rear one of which is shown. A shaft 7 is rotatably mounted in the two side frames 6 and can be rotated through an angle by means of the piston-cylinder unit 8', which is connected to the shaft 8 by means of a pivoted lever 8, which is secured to the shaft 7. The piston-cylinder unit 8' is secured by a bracket 10 to a crossbeam 11, which connects the two side frames 6. Beside the pivoted lever 8, two axially spaced apart links 12 are mounted on the shaft 7 and together with two additional links 13 mounted on a shaft 14 constitute a parallel crank linkage, in which the free ends of the links 13 are pivoted to a holder 15, which consists of two vertical plates 16 and a crosspiece 17 connecting said plates. In addition to the crosspiece 17, the means connecting the plates 16 comprise three shafts 18, 19 and 20. The entire holder 15 is held by the links 12 and 13, which are rotatably mounted on the shafts 18 and 20, respectively. Two spaced apart levers 21 and 22, which have the same length, are clamped at one end to each of the shafts 19 and 20 at their other end are pivoted to vertical arms 23, which at their lower ends are welded to a profiled carrying member 24. That carrying member 24 carries a pressure-applying rake consisting of a plurality of tines 25. Two spaced apart nozzles 26 for discharging hot melt adhesive are also secured to the carrying member 24 and are supplied with adhesive from a supply container through supply lines and other means, not shown, when such adhesive is required. The levers 21 and 22 can be pivotally moved in unison by means of the piston-cylinder unit 27, which is connected to the crossbeam 17, and the pivoted lever 28, which is clamped to the shaft 20.

That side of the machine which is on the right on the drawing is simpler in design. The rake tines 25' are also connected to a profiled carrying member 24' and the latter is connected to arms 23', which are secured to the levers 21' and 22'. At their ends which are remote from the arms 23', the levers 21' and 22' are secured to two shafts 19' and 20'. The pivoted lever 28' is also clamped on the shaft 19' so that the arms 23' and the rake tines 25' can be pivotally moved from the position indicated by solid lines to the position indicated by dotted lines. This is effected by the piston-cylinder unit 27' acting on the pivoted lever 28'. The shafts 19' and 20' are mounted in two vertical plates 16', which are held by a crosspiece. The forward ends of the tines 25' are interconnected by a folding rod 30. On that side which faces the end portion 4, the profiled carrying member 24' is provided with two spaced apart nozzles 26' for discharging hot melt adhesive. Said nozzles are identical to the nozzles 26. A welding device is disposed above the upright open sack end portion 4 and comprise a stationary welding or backing bar 31 and a pivoted welding bar 32, which is movable against the stationary welding or backing bar 31.

In the operation of the apparatus the top edge portion 4 of the sack 2 is held in an upright position and stretched in width by grippers 5. In that condition the sack is moved into the station 3 in the direction of the arrow A. When the sack 2 enters the station 3 the grippers 5 have been lowered to such an extent that the top edge of the sack will be held in the same elevation during the succeeding operations. In that position of the grippers the sack material disposed below the grippers 5 hangs down from the grippers in a limp and wrinkled condition to the top of the contents of the sack; that position of the sack material is indicated by dash-dot lines. To avoid an impact on the sack 2 as it enters the station 3, those rake tines which are shown on the left in the drawing are in the position indicated by solid lines. The sack 2 is stopped in that the belt conveyor 1 and the grippers 5 are arrested as soon as the top end portion 4 of the sack is in front of the stationary welding or backing bar 31. At that time the other bar 32 has been pivotally raised. The piston-cylinder unit 8' is subsequently operated to pivotally move the rake tines 25 to the position indicated at B so that they have the same elevation as the rake tines 25' indicated by solid lines. Thereafter the piston-cylinder units 27 and 27' are operated approximately at the same time to force the rake tines 25 and 25' against the contents of the sack from above so that the air contained in the sack 2 above its contents is forced out of the sack. Thereafter the movable welding bar 32 is pivotally moved against the backing bar 31 so that the sack is sealed by welding at its top edge.

When this has been accomplished the movable welding bar 32 is pivotally raised and the piston-cylinder units 27 and 27' are pressure-relieved or may even be supplied with fluid under a low pressure acting in the opposite sense so that the rake tines 25 and 25' are held in a balanced condition. Now the belt conveyor 1 is started to remove the sack 2. At this time holt melt adhesive is discharged from the nozzle 26 and 26' so that two parallel strips of adhesive are formed on the upper portion of the left-hand sack wall and two parallel strips of adhesive are formed on the sack end portion 4, which has been folded down by the rod 30. As has been described hereinbefore, the top end portion 4 of the sack is folded around the folding rod 30 against the adhesive strips applied by the two nozzles 26 so that said top end portion is perfectly flat. In a succeeding station the two laterally protruding wings of the sack are infolded onto the adhesive strips applied by the nozzles 26' and are thus fixed in position.

We claim:

1. Apparatus for closing filled sacks, preferably large sacks, which consist at least in part of thermoplastic material, comprising a feeder for feeding the filled sacks into a closing station, which feeder preferably comprises a roller conveyor or a belt conveyor, also comprising means for holding the top end portion of the sack above the contents of the sack, pressure-applying bars, which are parallel to each other and adapted to be lowered onto the contents of the sack on both sides of the sack end portion, which is held taut, which pressure-applying bars when in a lower position define between them a gap for the passage of the sack between said bars, and closing means provided above the pressure-applying bars, characterized in that the closing means welding bars and backing bars, which engage the sack end portion between the end-holding means and the pressure-applying bars and are disposed on opposite sides of said sack end portion, that of the pressure-applying bars which is disposed on the trailing side of the sack is provided with adhesive discharge nozzles directed toward the upper wall portion of the sack in contact with the contents of the sack, and that of said pressure-applying bars which is disposed on the leading side of the sack comprises a folding edge or folding rod, which faces the end of the sack and when the end seam weld has been formed and the welding and backing bars have released the sack and the conveyor has subsequently been restarted said folding edge or folding rod causes the end portion of the sack to be folded down onto and forced against the flattened upper portion of the trailing wall of the sack.

2. Apparatus according to claim 1, characterized in that that pressure-applying bar which is disposed on the leading side of the sack is also provided with adhesive discharge nozzles directed toward the downfolded sack end portion.

3. Apparatus according to claim 1, characterized in that the pressure-applying bars consist of rods which are arranged like grate bars or rake tines.

4. Apparatus according to claim 1, characterized in that each pressure-applying bar is platelike and covers approximately one-half of the top of the sack.

5. Apparatus according to claim 1, characterized in that the pressure-applying bars are provided with vertical carriers, which are connected to the frame by parallel crank linkages in such a manner that said carriers are adapted to be lowered in unison onto the contents of the sack on both sides of the sack end portion, which is held in a stretched condition, and said carriers are adapted to engage said contents of the sack in a horizontal plane.

6. Apparatus according to claim 5, characterized in that the parallel links of a parallel crank linkage are mounted in the frame and said parallel links and parallel links of another parallel crank linkage associated with the pressure-applying bar for engaging the trailing portion of the sack are pivoted to a common connecting rod on the same side so that said pressure-applying bar is adapted to be raised above the top edge of the top end portion of the sack, which top end portion is held by holding means moved in unison with the belt conveyor.

7. Apparatus according to claim 5, characterized in that one of the parallel links of each parallel crank linkage is secured to a shaft, which is connected by a lever to a fluid-operable piston cylinder unit for pivotally moving said parallel links by means of said lever and said shaft.

* * * * *